US005464352A

United States Patent [19]

Van Emmerick

[11] Patent Number: 5,464,352

[45] Date of Patent: Nov. 7, 1995

[54] ELECTRICAL CONNECTOR ASSEMBLY

[75] Inventor: David L. Van Emmerick, Dingley, Australia

[73] Assignee: Alcatel Components Limited, Melbourne, Australia

[21] Appl. No.: 151,163

[22] Filed: Nov. 12, 1993

[30] Foreign Application Priority Data

Nov. 13, 1992 [AU] Australia ..... PL5808
Apr. 23, 1993 [AU] Australia ..... PL8446

[51] Int. Cl.[6] ..... H01R 4/24
[52] U.S. Cl. ..... 439/404; 439/417; 439/719
[58] Field of Search ..... 439/395–405, 439/417–419, 719

[56] References Cited

U.S. PATENT DOCUMENTS

| | | | |
|---|---|---|---|
| 4,295,704 | 10/1981 | Narozny et al. | 439/404 |
| 4,441,778 | 4/1984 | Sampson | 439/404 |
| 4,484,791 | 11/1984 | Johnson | 439/404 |
| 4,538,873 | 9/1985 | Worth | 439/404 |
| 4,556,272 | 12/1985 | Briones | 439/404 |
| 4,932,892 | 6/1990 | Hatch | 439/395 |
| 5,104,336 | 4/1992 | Hatanaka et al. | 439/404 |
| 5,125,850 | 6/1992 | Locati | 439/404 |
| 5,211,570 | 5/1993 | Bitney . | |

FOREIGN PATENT DOCUMENTS

| | | |
|---|---|---|
| 0404450 | 12/1990 | European Pat. Off. . |
| 2197548 | 5/1988 | United Kingdom . |

OTHER PUBLICATIONS

Abstract, Saegusa Kazuo, *Patent Abstract of Japan*, vol. 16, No. 45 (E–1162), Feb. 5, 1992 and JP–A–03 250 566 (Ito Denki KK), Nov. 8, 1991.

Abstract, Hirai Yuji, *Patent Abstract of Japan*, vol. 16, (E–1154) Jan. 14, 1992 and JP–A–03 233 876 (Honda Tsushin Kogyo KK), Oct. 17, 1991.

*Primary Examiner*—David L. Pirlot
*Attorney, Agent, or Firm*—Ware, Fressola, Van Der Sluys & Adolphson

[57] ABSTRACT

A panel mounting electrical coupling connector element comprising a housing (7) in which are supported a plurality of mateable contact elements (9, 10) whose rear ends terminate in insulation-penetrating slotted blades (12, 13 and 14) that are respectively located in wire-guide channels at the rear of the housing (7). The connector includes a hinged clamp (17) arranged such that when insulated wires (25, 26 and 27) are laid in respective wire-guide channels and the hinged clamp is closed, protuberances on the hinged clamp urge the insulated wires into the slots of the slotted blades thereby making electrical contact between the conductor of the wires and the mateable contact elements.

11 Claims, 9 Drawing Sheets

ELECTRICAL CONNECTOR ASSEMBLY

TECHNICAL FIELD

This invention relates to electrical connectors and in particular to a panel mounting connector element for coupling with a mating free connector element, particularly, though not exclusively, for disconnectably connecting the conductors of audio cables to appliances or chassis.

BACKGROUND OF THE INVENTION

Panel mounting connector elements are known and basically comprise a mounting plate attached to a socket arrangement for receiving a mating plug. Within the socket arrangement is supported at least one contact element, either male or female. These contact elements protrude rearwardly where they are electrically connected to conductors connected to various components associated with the appliance or chassis on which the connector element is mounted. The contact elements are electrically connected to respective conductors by various known means, such as, for example, soldering, crimping or screw terminals.

During the manufacture of appliances or chassis-mounted electrical devices incorporating panel mounting connector elements, the termination of conductors on connector element's contact element/s introduces further steps in the assembly of the appliance or chassis which may increase production time and require additional skills of assemblers. Further, if termination is by soldering, hazardous fumes produced during soldering may introduce health and safety problems in the assembly area.

SUMMARY OF THE INVENTION

It is an object of the present invention to provide a panel mounting connector element arrangement to which insulated conductors can be terminated in a quick and easy manner requiring no special skill.

According to a first aspect of the invention there is provided an electrical coupling connector element assembly, comprising a contact element housing member fixedly supporting at least one forwardly extending mateable contact element whose opposite end transfixes a rear wall of said contact element housing and terminates in a rearwardly extending insulation-penetrating means, a co-axial wire-guide member having at least one wire-guide channel on a surface thereof and in which said channel is located a slot through which said insulation-penetrating means protrude, and a clamping member arranged to co-operate with said wire-guide means to clamp under axial force an insulated wire conductor laid in said channel across said slot, whereby said insulation-penetrating means penetrates said insulated wire's insulation when a wire-guide member having a clamped insulated conductor in said channel is mated with said contact element housing to provide electrical connection between said insulated wire's conductor and said contact element.

According to a further aspect of the present invention there is provided an electrical coupling connector element comprising a contact element housing fixedly supporting at least one forwardly extending mateable contact element whose opposite end transfixes a rear wall of said contact element housing and terminates in a rearwardly extending insulation-penetrating means, said insulation-penetrating means being located in a wire-guide channel provided in said rear wall, wherein said connector element further includes a clamping means arranged to co-operate with said rear wall such that when an insulated-wire is laid in said wire-guide channel and axial force applied to said clamping means, a protuberance on said clamping means urges said insulated-wire against said insulation-penetrating means thereby cutting the insulated-wire's insulation and contacting the insulated-wire's conductor to provide electrical connection between said insulated-wire's conductor and said contact element.

BRIEF DESCRIPTION OF THE DRAWINGS

In order that the invention may be readily carried into effect, an embodiment thereof will now be described in relation to the accompanying drawings, in which.

BEST MODE FOR CARRYING OUT THE INVENTION

Figure 1:
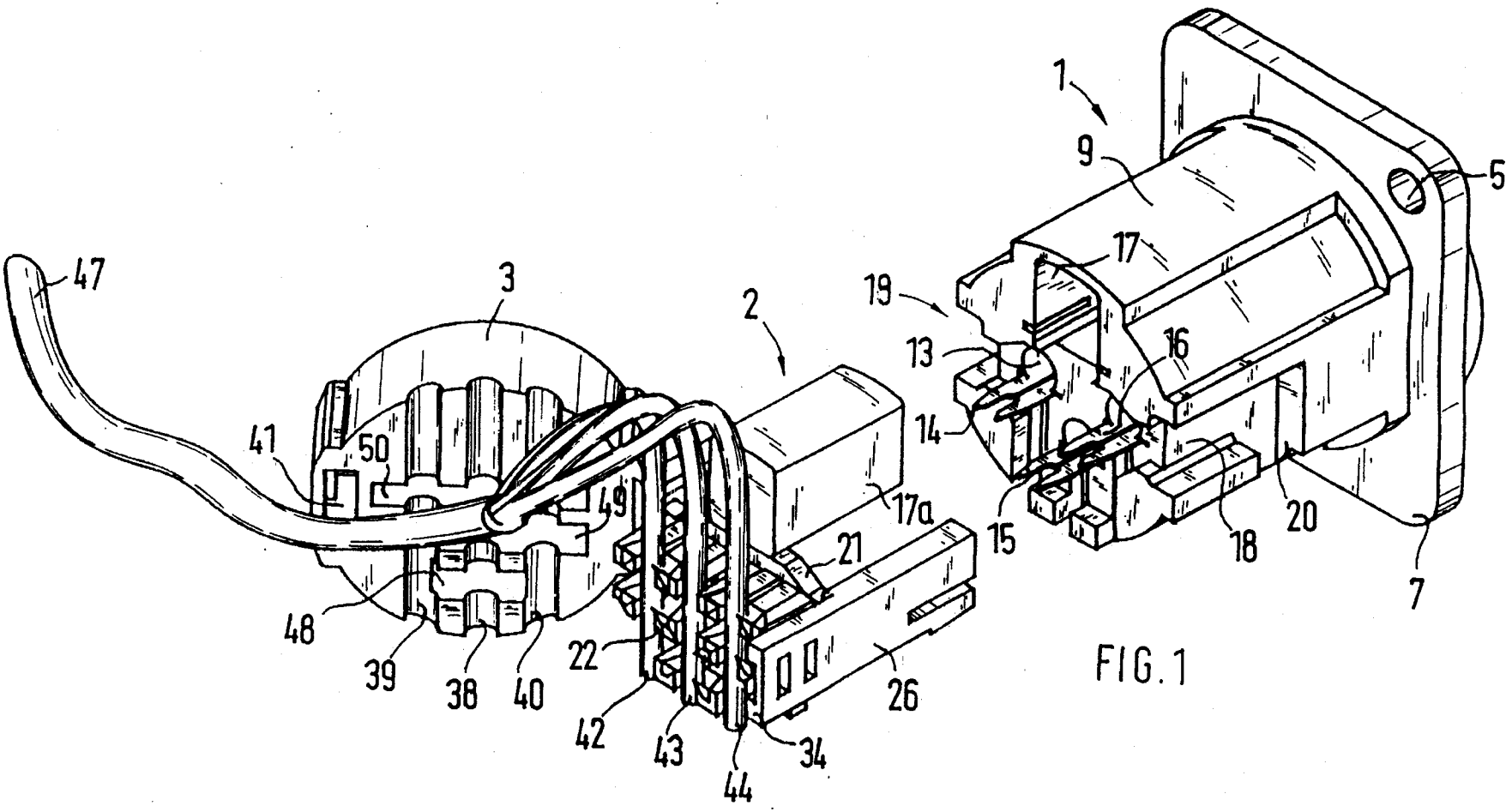
FIG. 1 shows a perspective view of an embodiment of a connector assembly of the present invention.

Referring to FIG. 1, the connector assembly comprises a contact element housing member 1, a wire-guide member 2 and a clamping member 3.

Figure 4:
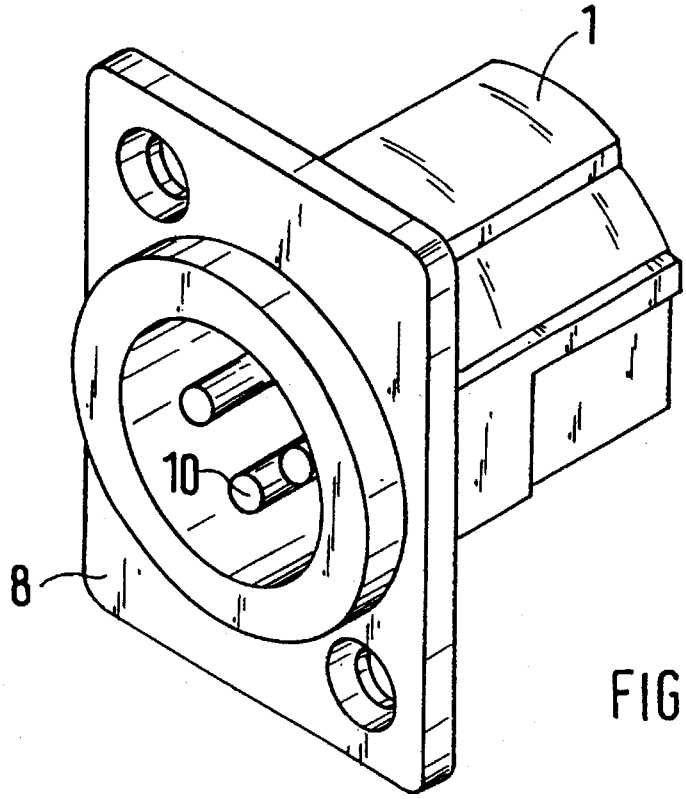
FIGS. 4 and 4*a* show a front perspective view of the contact element housing member of the assembly shown in FIGS. 1–3, respectively showing male and female contact elements.
Figure 4A:
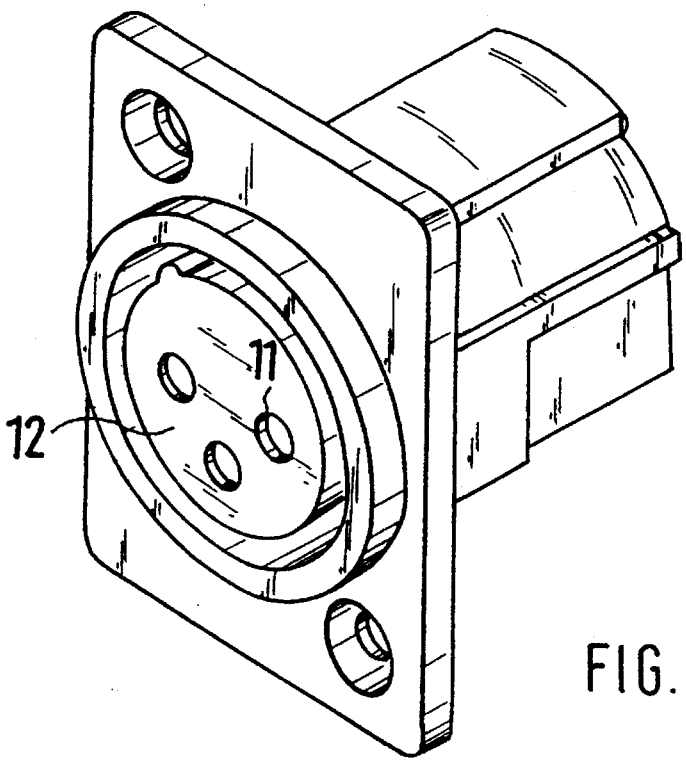
Figure 5:
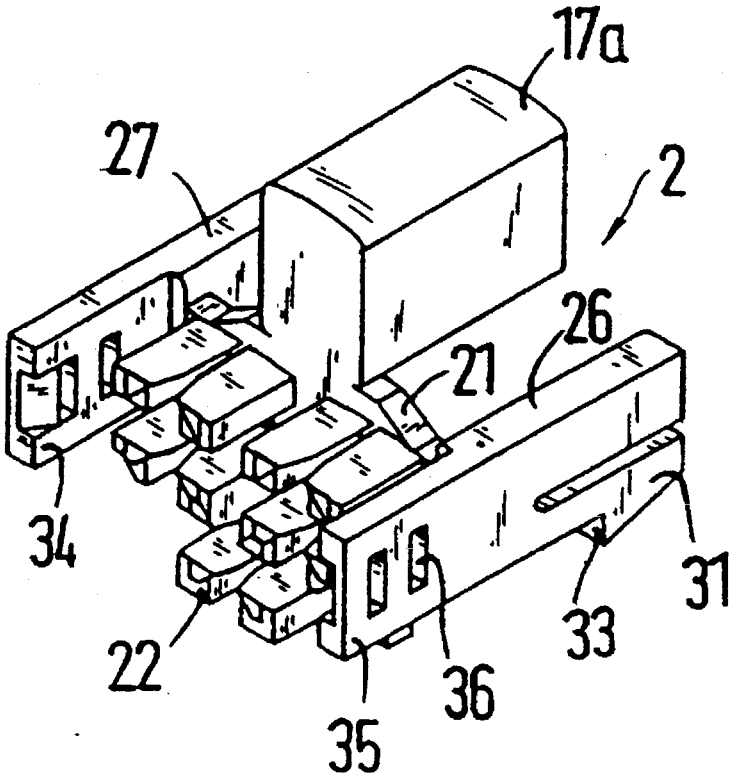
FIG. 5 shows a perspective view of the wire-guide member of the assembly shown in FIGS. 1–3.

Contact element housing member 1 comprises a rectangular mounting plate 4 having two screw holes one of which is shown for attaching the connector to a panel or chassis (not shown), a rear face 7 and a front face 8 (FIGS. 4 and 5) and a connector body 9 of generally circular cross-section fixed to the rear face 7. Front face 8 comprises a socket receptacle containing an array of either male contact elements 10 as shown in FIG. 4 or female contact elements 11 formed in an insert 12 as shown in FIG. 4*a*.

Within the boundary of connector body 9 the aforementioned array of contact elements extend rearwardly fixedly supported within cylindrical cavities (not shown) whose axes lie in a plane substantially parallel to the axis of connector body 9. Attached to the rear portion of each contact element is a rearwardly extending insulation-penetrating slotted plate 14, 15 and 16.

Figure 5A:
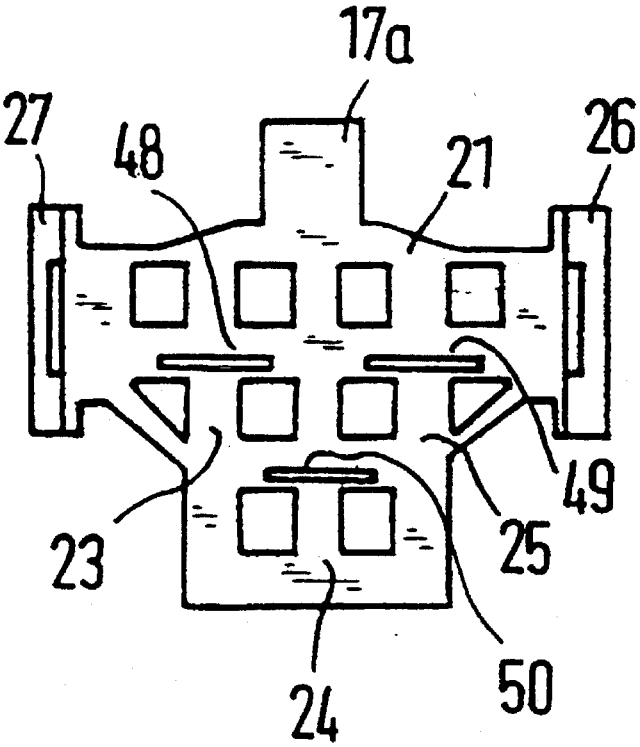
FIG. 5*a* shows a front view of the wire-guide member shown in FIG. 5.

Connector body 9 further includes an alignment receptacle 17 for co-operating with an alignment plug to be described in relation to the wire-guide member. Connector body 9 includes a pair of spaced, open ended, grooves 18 and 19 each having a shoulder 20, Referring to FIGS. 5 and 5*a*, wire-guide member 2 comprises a planar body 21 of a generally rectangular shape having an array of fingers 22 extending perpendicularly from a surface thereof forming column channels 23, 24 and 25 (FIG. 5*a*) therebetween. Within each channel is located a transverse slot 48, 49 and 50 for receiving therethrough respective insulation-penetrating slotted plates 14, 15 and 16 when wire-guide member 2 is attached to contact element housing 1.

On each of the two opposite edges of body 21 is attached an arm 26, 27 to form a pair of spaced substantially parallel arms for detachably attaching wire-guide member 2 to contact housing member 1. The pair of arms are of such dimension that they slidably fit into the spaced open ended grooves 18 and 19 of connection body 9. On one end of each of arms 26 and 27 there is provided a resilient finger 28, 29 having a chamfered surface 30, 31 and a detent 32, 33. Detents 32, 33 co-operate with shoulders 20 of grooves 18 and 19 in connection body 9 when the wire-guide member and the connector body are mated.

On the other end of each of arms 26, 27 there is provided a pair of rearward extensions of arms 26, 27 designated 34 and 35, for co-operating with clamping member 3 to latch the clamping-member to the wire-guide member. One of each of the rearward extensions is provided with latching means in the form of indentations 36 for co-operating with protuberances (not shown) within at least one receptacle in the clamping member. Wire-guide member 2 further includes an axially extending plug 17*a* for nesting in alignment receptacle 17 provided in the body of contact element housing member 1 for ensuring correct alignment of the wire-guide member and said housing member on assembly. Clamping member 3 is hingedly attached to wire-guide member 2 in the embodiment shown in FIGS. 1–3 and therefore only one latching means is provided. However, in the embodiments shown in relation to FIGS. 6–9, both rearward extensions are provided with latching means.

Figure 2:
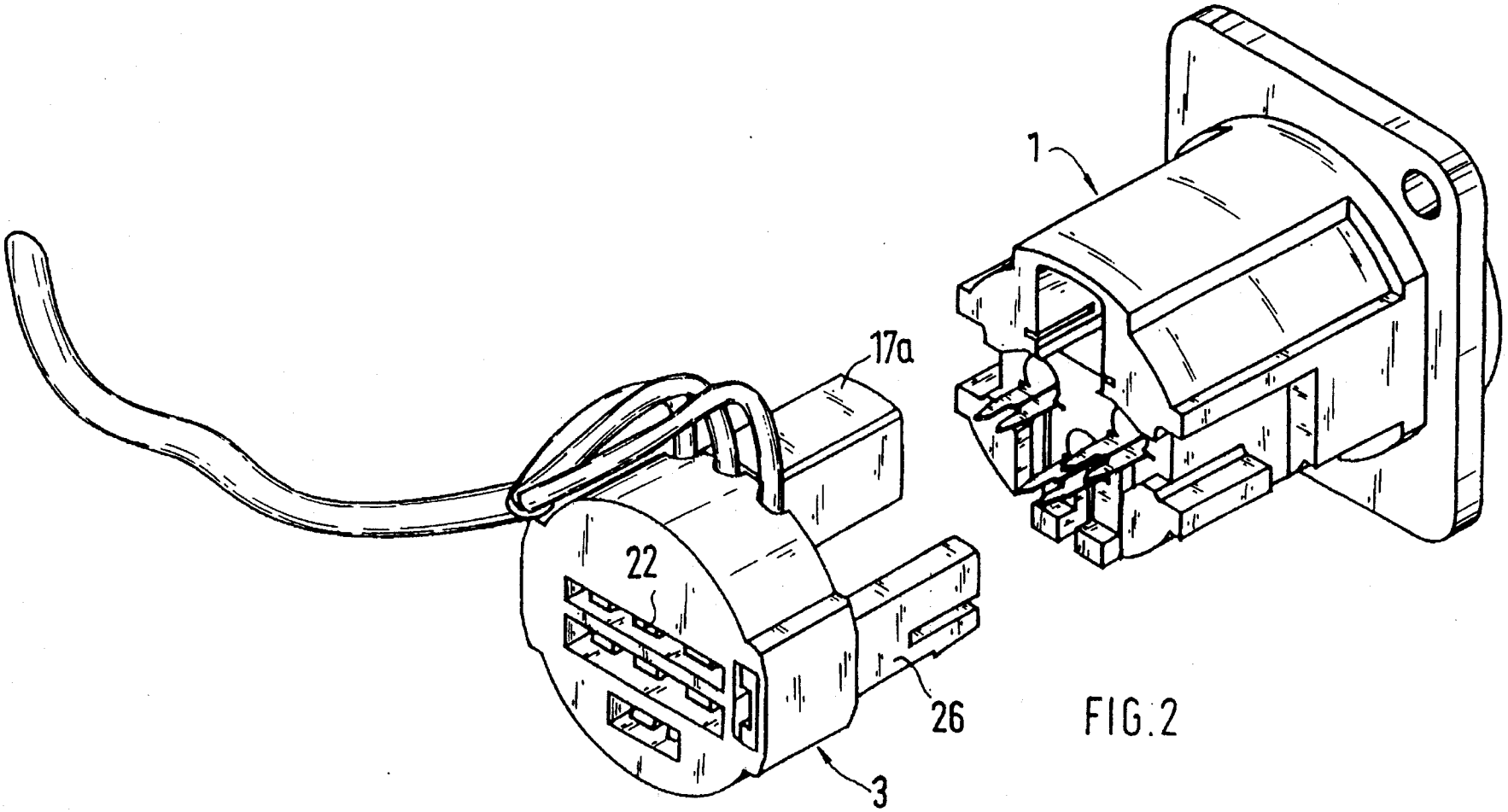
FIG. 2 shows a perspective view of the connector assembly shown in FIG. 1 partly assembled.
Figure 3:
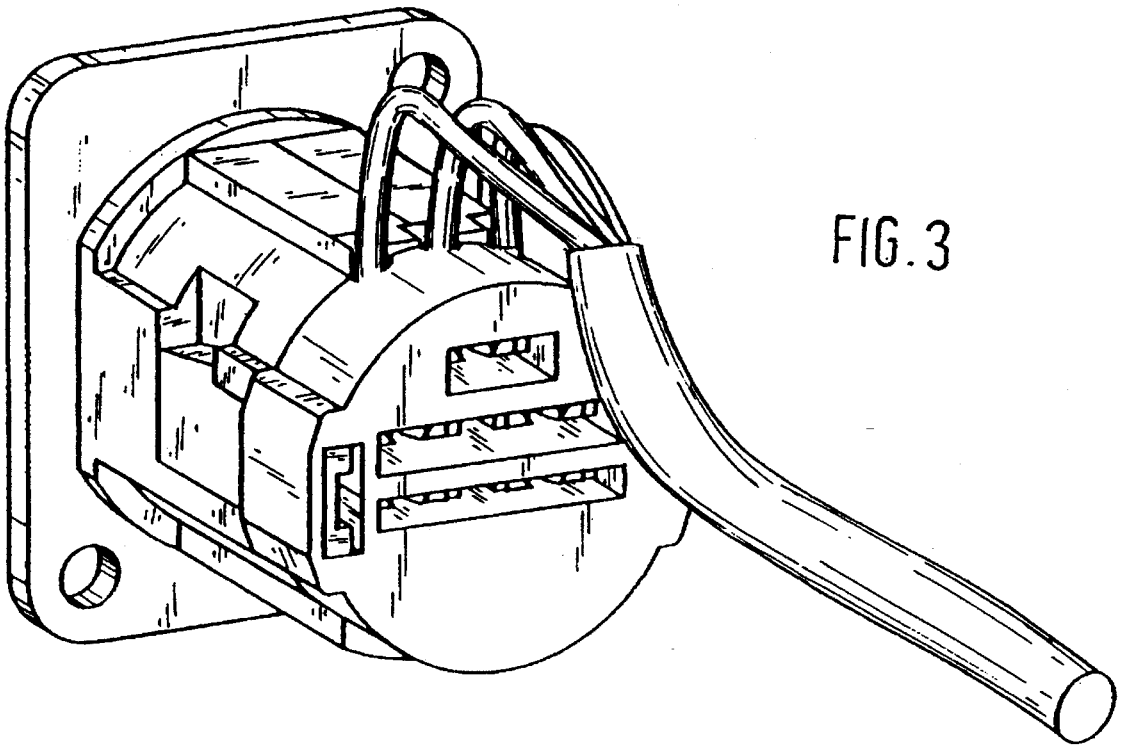
FIG. 3 shows a perspective view of the connector assembly shown in FIG. 1 fully assembled.

Clamping member 3 comprises a disc-shaped body which, as shown in FIGS. 1–3, is hingedly attached to wire-guide member 2 by a hinge 37. That surface of the clamping member which interfaces with the surface of the wire-guide member from which the array of fingers extend is provided with an array of parallel grooves 38, 39 and 40 which coincide with channels 23, 24 and 25 formed in wire-guide 3. Three transverse slots 48, 49 and 50 allow the array of fingers 22 to nest therein when clamping member 3 is clamped to wire-guide member 2. Clamping member 3 also is provided with a latching slot 41 which co-operates with rearward extension 34. Within latching slot 41 are protuberances (not shown) which resiliently nest within indentations 36 on rearward extension 34. Grooves 38, 39 and 40 are dimensioned such that when clamping member 3 is snapped into wire-guide member 2 in whose channels 23, 24 and 25 are laid three insulated wire conductors 42, 43 and 44, the insulated wire conductors are fixed in the channels ready for penetration by the insulation-penetrating slotted plates 14, 15 and 16.

Figure 6:
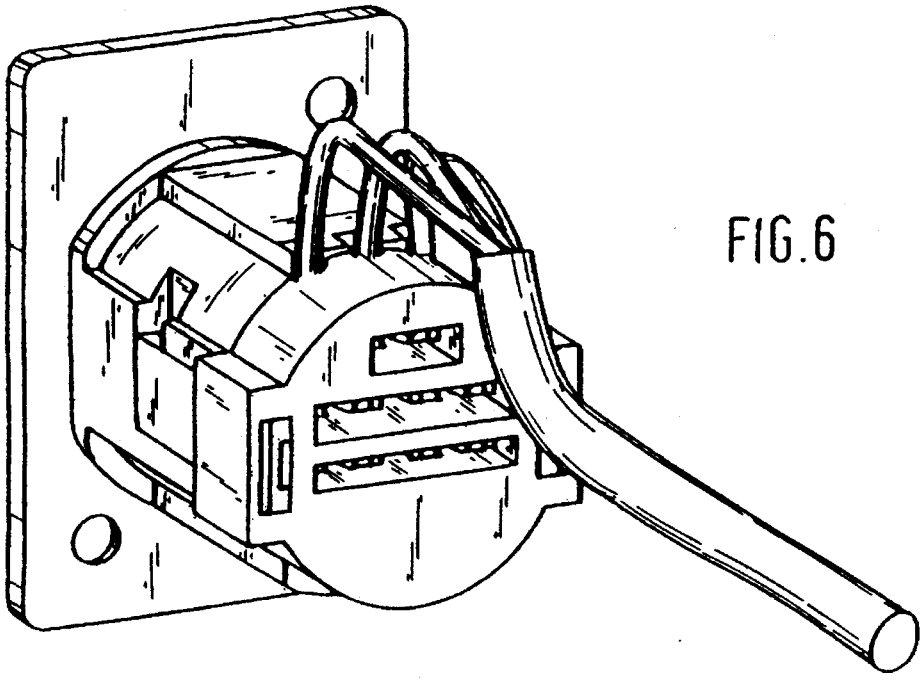
FIG. 6 shows a perspective view of a fully assembled second embodiment of a connector assembly of the present invention.
Figure 7:
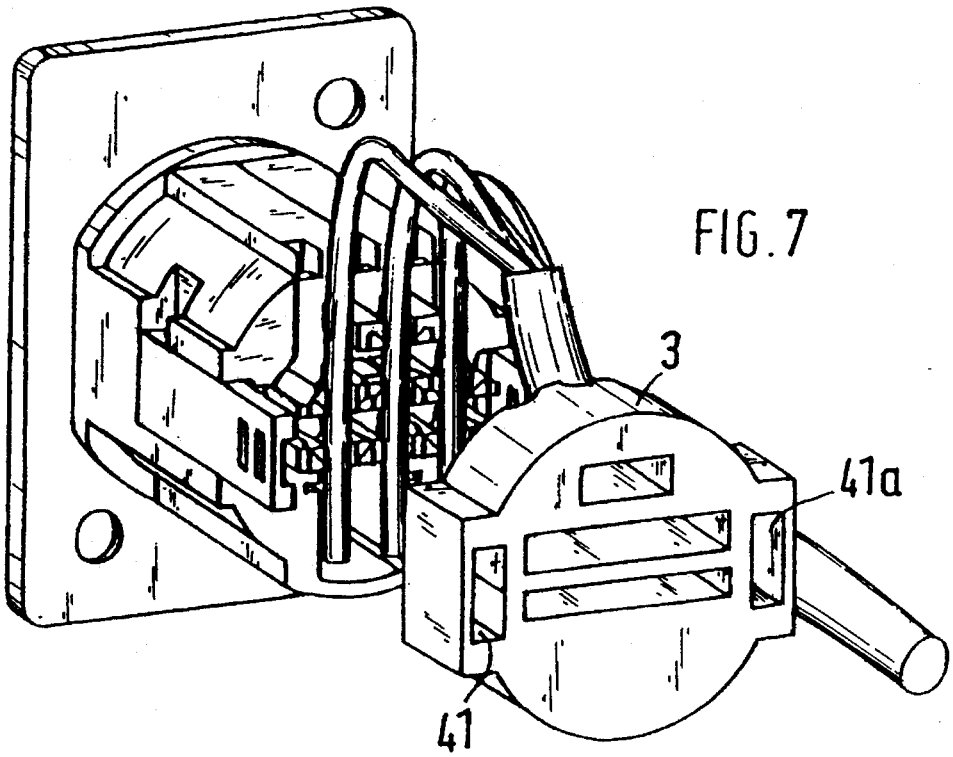
FIG. 7 shows a perspective view of the connector assembly shown in FIG. 6 partly assembled.

The embodiment shown in FIGS. 6 and 7 incorporates an unhinged clamping member and is provided with a second latching slot 41 a which co-operates with a second rearward extension (not shown) in a similar manner to that described in relation to the first rearward extension.

Figure 8:
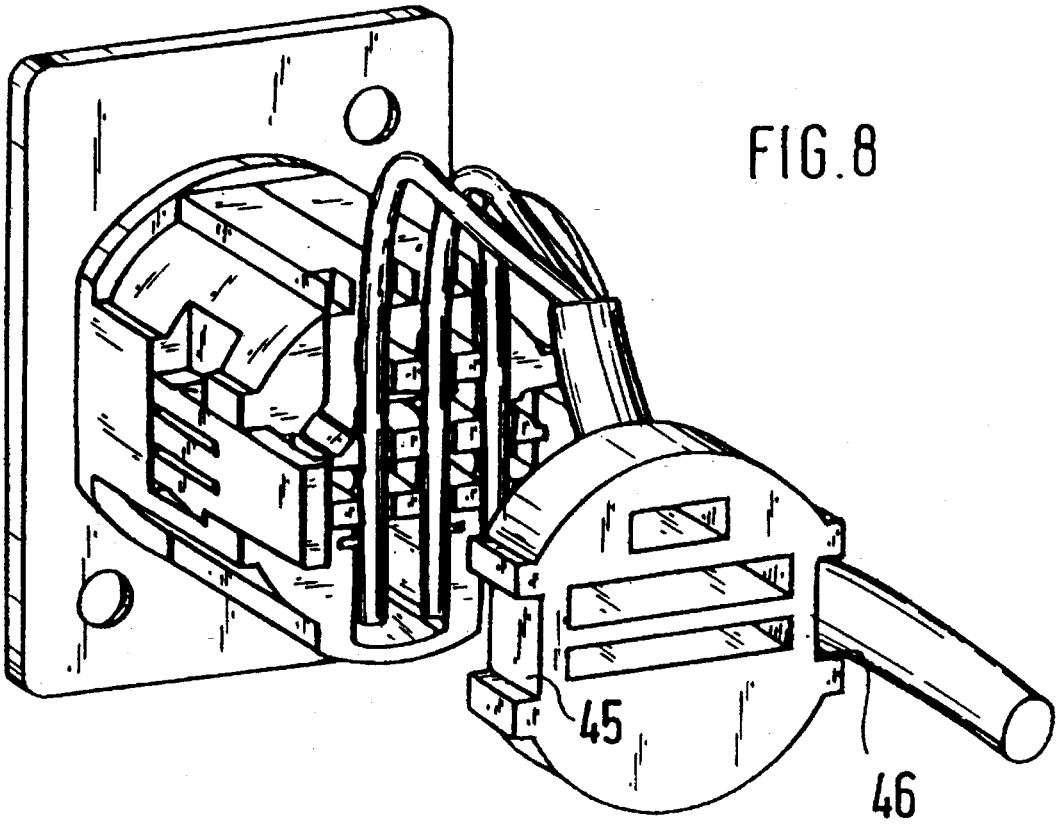
FIG. 8 shows a perspective view of a fully assembled third embodiment of a connector assembly of the present invention.
Figure 9:
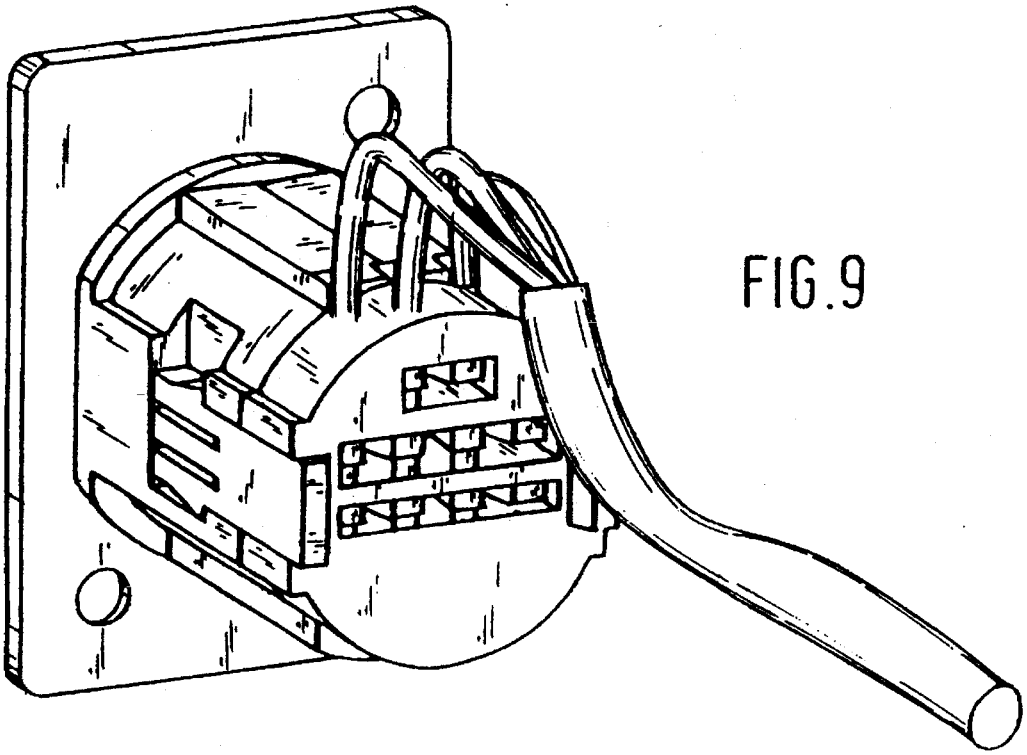
FIG. 9 shows a perspective view of the connector assembly shown in FIG. 8 partly assembled.

Referring to the embodiment shown in FIGS. 8 and 9, the clamping member 3 is provided with a pair of spaced grooves 45 and 46 instead of slots. Grooves 45 and 46 latchingly co-operate with rearward extensions when the clamping member is snapped closed.

In use, and referring to FIG. 1–3, three lengths of insulated conductor 42, 43 and 44 of a cable 47 are laid in respective column channels 23, 24 and 25. Clamping member 3 is snapped closed and latched by the latching operation of latching slot 41 and rearward extension 34. Thus each insulated conductor is fixed within respective channels and lays across a transverse slot (48, 49, 50 FIG. 5*a*). Thus when the so assembled wire-guide member 2 is mated with contact element housing 1, the insulation-penetrating slotted plates enter the transverse slots causing inner cutting edges of the slots to cut into the insulation of the insulated conductors thereby electrically connecting the conductors to the contact elements.

Alternately, as shown in FIGS. 6–9 contact element housing member 1 and wire-guide member 2 may be assembled first, the conductors laid in the channels and finally the clamping member snapped on whereupon the insulated conductors are penetrated by the insulation-penetration slotted plates.

Figure 10:
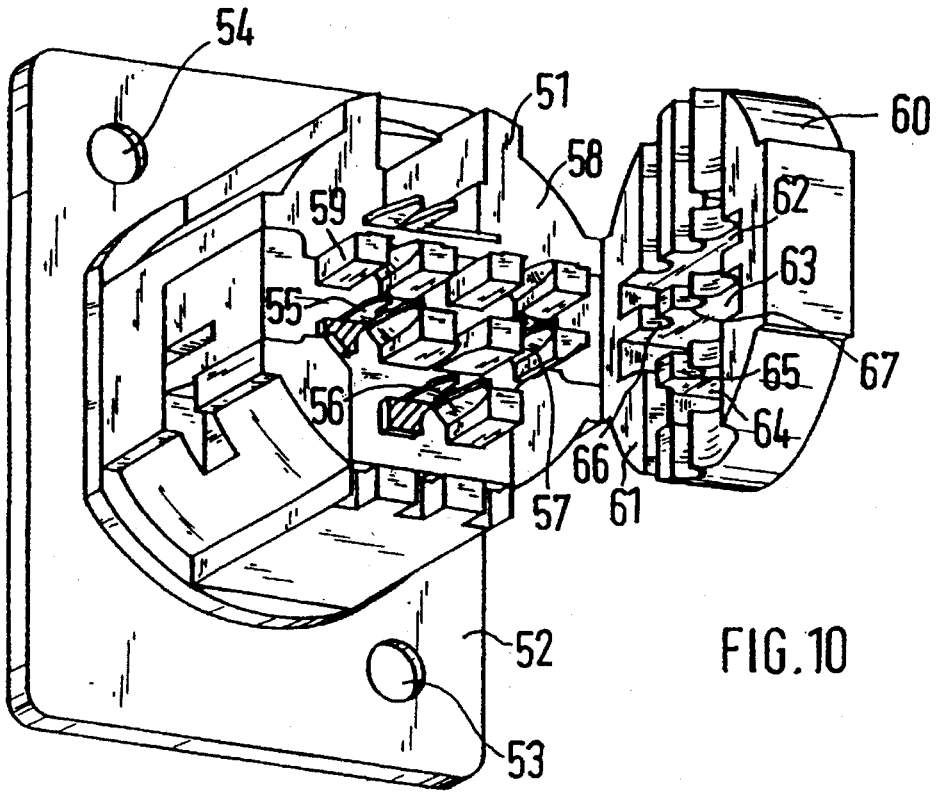
FIG. 10 shows a perspective view of a fourth embodiment of a connector assembly of the present invention.
Figure 11:
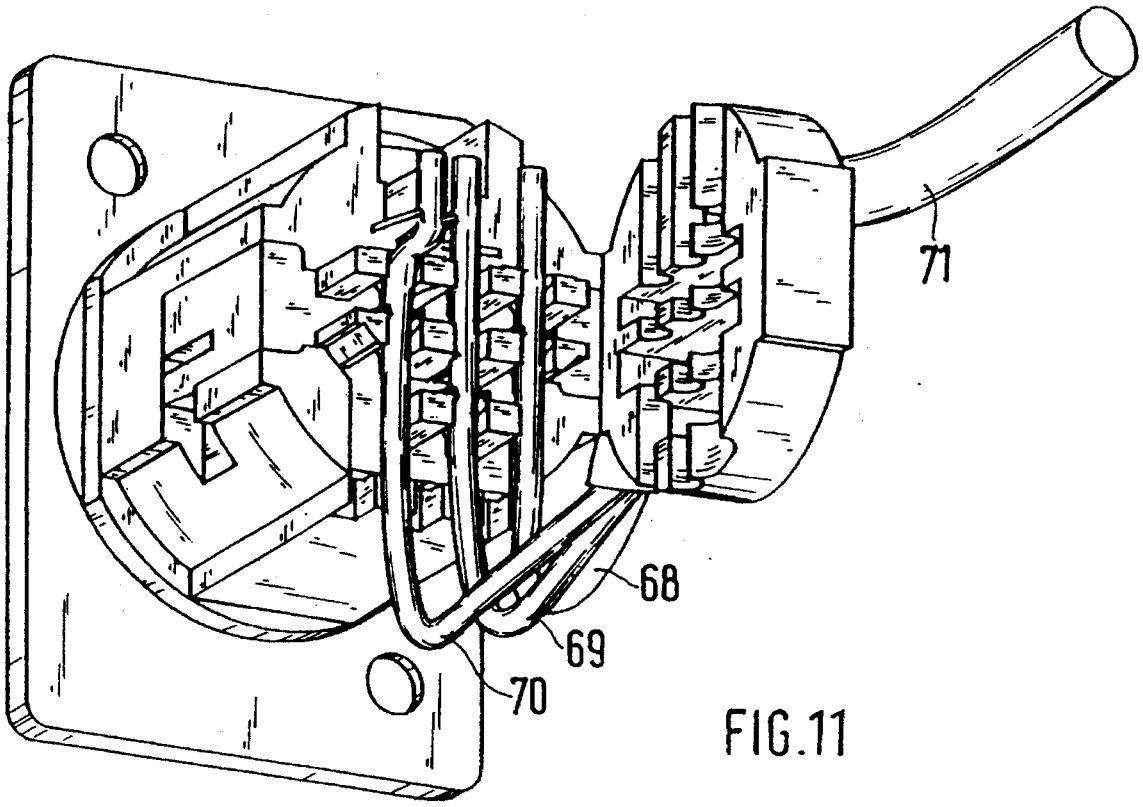
FIG. 11 shows the connector assembly of FIG. 10 including un-terminated insulated wires ready for termination.
Figure 12:
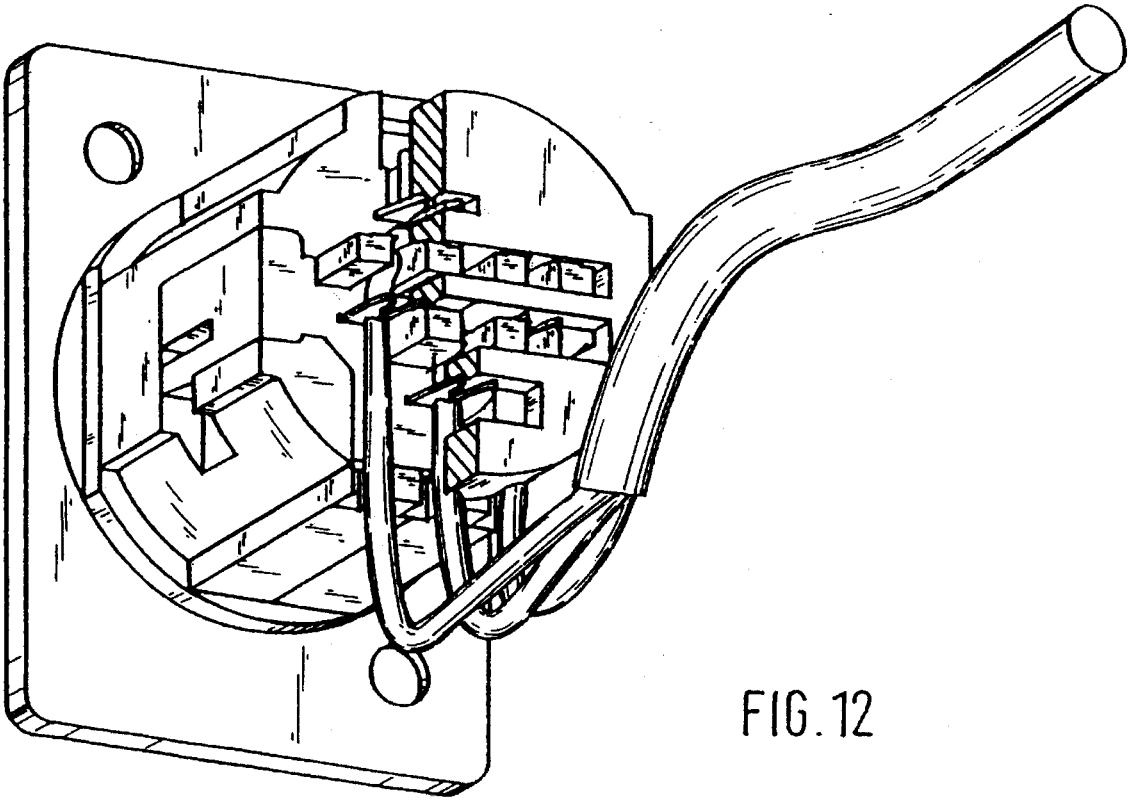
FIG. 12 shows the connector assembly of FIG. 11 with the insulated wires terminated.

Referring to FIGS. 10, 11 and 12, the embodiment shown is similar to the embodiment shown in relation to FIG. 1, except that the contact element housing member and the wire-guide member are integral, forming a single connector body 51 of a generally circular cross-section attached to a rear face of a rectangular plate 52 having two screw holes 53 and 54 for attaching the assembly to a panel or chassis (not shown). The front face (not shown) of plate 52 comprises a socket receptacle containing an array of either male or female contact elements as shown in FIGS. 4 and 4*a*.

Within the boundary of connector body 51 the aforementioned array of contact elements extend rearwardly fixedly supported within cylindrical cavities (not shown) whose axes lie in a plane substantially parallel to the axis of connector body 51. Attached to the rear portion of each contact element is a rearwardly extending insulation-penetrating slotted plate 55, 56 and 57.

Protruding perpendicularly from the rear surface 58 of connector body 51 is an array of ten fingers 59, two of which are shown cut away, forming two rows and three columns of wire-guide slots therebetween; the slots in slotted plates 55, 56 and 57 lying within respective columns of wire-guide slots such that the slot and the wire-guide slot are bisected by the same plane.

Hingedly attached to rear surface 58 of connector body 51 is a clamping element 60 the inner surface 61 of which is provided with three slots 62, 63 and 64 arranged to receive the array of fingers 59 when the clamping element 60 is closed upon connector body 51, permitting inner surface 61 of clamping element 60 and rear surface 58 of connector body 51 to interface. Inner surface 61 of clamping element 60 is also provided with slotted protuberances 65, 66 and 67 which are arranged so that they protrude in the columns of guide slots when clamping element 60 is closed.

Clamping element 60 is also provided with a snap-lock arrangement (not shown) which latches the clamping element to the connector body when closed.

In use, three predetermined lengths of insulated conductor 68, 69 and 70 (FIG. 11) of a cable 71 are laid in respective column guide-slots. In doing so, each insulated conductor lays in the entrance to respective slots of slotted plates 55, 56 and 57 located in the wire-guide-slots. Upon closing clamping element 60 (FIG. 12), the slotted protuberances 65, 66 and 67 co-operatively engage insulated conductors 68, 69, and 70 and urge the said conductors into the slots of the slotted plates causing inner cutting edges of the slots to cut into the insulation of the insulated conductors thereby electrically connecting the conductors to the contact elements.

The cable 71 may include an un-insulated shielding sheath, and it is envisaged that this sheath can be connected to a contact element of the connector by contact with an insulation-penetrating slotted plate.

I claim:

1. A panel mounting insulation-displacement connector for terminating a cable including one or more individual insulated wires, the connector comprising:

a contact retaining body having one or more insulation displacement contacts with insulation displacement means, each for receiving an individual insulated wire of the cable;

a wire guide member having at least one wire channel with an open top opposite a closed bottom surface, each of said at least one channel for retaining an individual insulated wire of the cable, each wire channel being transected by at least one transverse channel, each wire channel and each transverse channel being formed by interstices between an array of fingers having at least two rows projecting from a base of the wire guide member, each wire channel including in its bottom surface a blade aperture in the region of the transverse channel through which one of the insulation displacement means protrudes to lie substantially transverse to the wire channel; and a clamping member including one or more displacement members, each displacement member being adapted to be received in a corresponding one of the transverse channels to force each individual insulated wire into a corresponding one of the insulation displacement means; the clamping member and the wire guide member having corresponding first and second latching elements which cooperate to attach the clamping member to the wire guide member.

2. A connector as claimed in claim 1, wherein each wire channel has a portion with a reduced cross-section in which the insulated wire is a press fit.

3. A connector as claimed in claim 1, wherein the insulation displacement means is a substantially planar bifurcated blade.

4. A connector as claimed in claim 1, wherein the wire guide member is integral with the contact retaining body.

5. A connector as claimed in claim 1, wherein each wire channel has a depth which is greater than half the diameter of the insulated wire.

6. A connector as claimed in or claim 5, wherein each wire channel has a portion with a reduced cross-section in which the insulated wire is a press fit.

7. A connector as claimed in claim 6, wherein the insulation displacement means is a substantially planar bifurcated blade.

8. A connector as claimed in claim 7, wherein each blade aperture is substantially parallel with, and proximate to, a wall of the corresponding transverse channel, and is transverse to the bottom and side walls of the corresponding wire channel.

9. A connector as claimed in claim 8, wherein the wire guide member is integral with the contact retaining body.

10. A connector as claimed in claim 1, wherein the wire guide member is a separate member, the wire guide member and the contact retaining body including respective cooperating third and fourth latching means.

11. A connector as claimed in claim 10, wherein each displacement member has a forward end to engage one or more insulated wires, the forward end being provided with arcuate cutouts to engage each insulated wire.

* * * * *

UNITED STATES PATENT AND TRADEMARK OFFICE

CERTIFICATE OF CORRECTION

PATENT NO. : 5,464,352
DATED : Nov. 7, 1995
INVENTOR(S) : David L. Van Emmerik

It is certified that error appears in the above-indentified patent and that said Letters Patent is hereby corrected as shown below:

On the title page, item [75]:

Please delete "David L. Van Emmerick" and insert --David L. Van Emmerik--.

Item [19] should read --Van Emmerik--

Signed and Sealed this

Thirteenth Day of August, 1996

*Attest:*

*Attesting Officer*

BRUCE LEHMAN

*Commissioner of Patents and Trademarks*